United States Patent [19]

Ross et al.

[11] 4,049,364

[45] Sept. 20, 1977

[54] REMOVABLE IMPELLER ASSEMBLY FOR PRINTING PRESS CENTRIFUGAL PUMP

[75] Inventors: Joseph Ross, Brooklyn; Ernest F. Fuchs, Middle Village, both of N.Y.

[73] Assignee: Ace Envelope Manufacturing Corporation, New York, N.Y.

[21] Appl. No.: 657,963

[22] Filed: Feb. 13, 1976

Related U.S. Application Data

[63] Continuation-in-part of Ser. No. 484,429, July 1, 1974, Pat. No. 3,947,152.

[51] Int. Cl.[2] ..... F04B 39/14

[52] U.S. Cl. ..... 417/360; 416/244 A; 403/301

[58] Field of Search ..... 417/360, 359, 424; 415/170 R; 416/244 R, 244 A; 403/383, 301, 329; 64/1 V, 1 R

[56] References Cited

U.S. PATENT DOCUMENTS

| | | | |
|---|---|---|---|
| 2,252,855 | 8/1941 | Lasch | 403/383 |
| 2,280,979 | 4/1942 | Rocke | 417/424 |
| 2,326,360 | 8/1943 | Ingersoll | 417/424 |
| 2,445,182 | 7/1948 | Odey | 417/359 |
| 2,525,370 | 10/1950 | Pollak | 417/424 |
| 2,764,943 | 10/1956 | Peters | 417/424 |
| 2,875,697 | 3/1959 | Fernstrum | 417/424 |
| 3,056,911 | 10/1962 | Hart et al. | 417/424 |
| 3,145,018 | 8/1964 | Goodwiler | 403/383 |
| 3,169,403 | 2/1965 | McGinn | 403/229 |
| 3,947,152 | 3/1976 | Ross et al. | 417/424 |

*Primary Examiner*—C. J. Husar
*Attorney, Agent, or Firm*—Philip D. Amins

[57] ABSTRACT

A centrifugal pump assembly, having a removable impeller assembly for use in conjunction with ink reservoirs of printing press apparatuses. There is provided a centrifugal pump assembly comprising motor mounting means for mounting the motor with respect to the cover member of an ink reservoir. The shaft of the motor extends downwardly into the reservoir and has secured thereto a coupling sleeve. The coupling sleeve includes means for securing the same to the motor shaft and means for releasably engaging the impeller shaft of the pump assembly. The impeller shaft is provided with a positive drive pin adapted to fit into a slot formed in the coupling sleeve to thereby properly align said impeller shaft with respect to the impeller housing and to insure proper positive connection of the impeller shaft with respect to the motor shaft for corresponding rotational movement therewith. An alternate embodiment utilizes a hollow barrier sleeve to prevent ink from traveling upwardly into the motor. The impeller engages the portion of the shaft of the motor which extends below the barrier sleeve utilizing a flat on the shaft of the motor engaged within a semi-circular opening in the impeller. The releasable engagement of the impeller wth respect to the motor shaft permits disengagement of the motor from the centrifugal pump assembly prior to washing and cleansing operations of the impeller assembly and ink reservoir.

8 Claims, 8 Drawing Figures

REMOVABLE IMPELLER ASSEMBLY FOR PRINTING PRESS CENTRIFUGAL PUMP

The present application is a continuation-in-part of our previously filed patent application, Ser. No. 484,429, filed July 1, 1974, entiled PRINTING PRESS CENTRIFUGAL PUMP ASSEMBLY, and now identified by U.S. Pat. No. 3,947,152.

BACKGROUND OF THE INVENTION

The present invention pertains to a new and novel centrifugal pump assembly and, more particularly, to a centrifugal pump having a removable impeller assembly for use in conjunction with ink reservoirs employed in printing presses.

Prior art centrifugal pump assemblies employed in conjunction with printing operations have presented serious problems when the cleaning of the ink reservoir and impeller assemblies have been required. In this regard, these prior art pump assemblies incorporated electrical motors which were fixedly secured to the impeller assembly and to the reservoir cover plate. Thus, when the impeller assembly and reservoir cover were to be cleaned, to remove ink accummulations or change the color of ink employed, care had to be taken not to have the cleansing solution contaminate the motor. Since the workmen employed to complete these tasks were not usually careful, many motors were burned out necessitating complete disassembly of the centrifugal pump assembly and replacement of the motor. The frequency of motor replacement was very high and extremely costly from both a material and labor point of view.

Accordingly, it is the primary object of the present invention to provide a new and novel centrifugal pump assembly which is specifically intended for use in conjunction with ink reservoirs of printing presses.

It is another object of the present invention to provide a centrifugal pump assembly of the foregoing type employing releasable engaging means between the motor shaft and impeller shaft of the pump assembly.

It is still another object of the present invention to provide a centrifugal pump assembly of the foregoing type having means for enabling the motor of the pump assembly to be quickly and detachably secured to the reservoir cover plate.

It is still a further object of the present invention to provide a pump assembly of the foregoing type including releasable engageable coupling means between the motor shaft and impeller shaft of the pump assembly.

It is yet another object of the present invention to provide a centrifugal pump assembly as aforesaid including positive drive and alignment means between the coupling means and the impeller shaft to insure proper alignment of the impeller shaft in the impeller housing and proper rotational movement of the impeller shaft in correspondence with the motor shaft.

It is a further object of the present invention to provide a centrifugal pump assembly of the foregoing type including ink flow restraining means preventing the accidental communication of ink from the reservoir to the motor.

BRIEF DESCRIPTION OF THE DRAWINGS

The foregoing and other objects, features and advantages of the present invention will become more apparent from the detailed description hereinafter when considered in conjunction with the accompanying drawings, wherein.

DETAILED DESCRIPTION OF THE PREFERRED EMBODIMENTS

Figure 1:
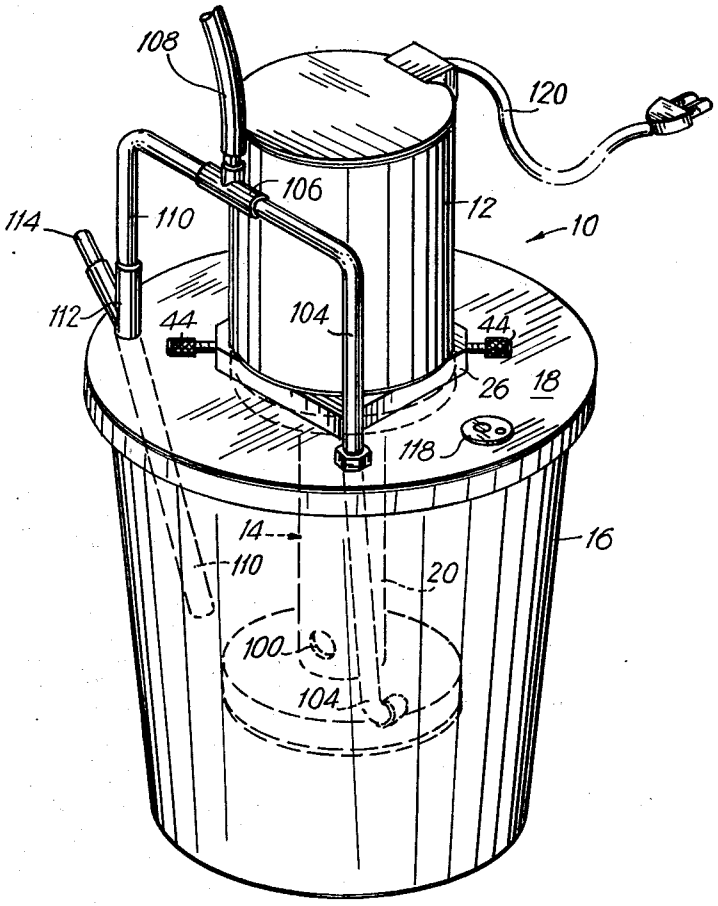
FIG. 1 is a perspective view of the new centrifugal pump assembly for use in conjunction with an ink reservoir.
Figure 3:
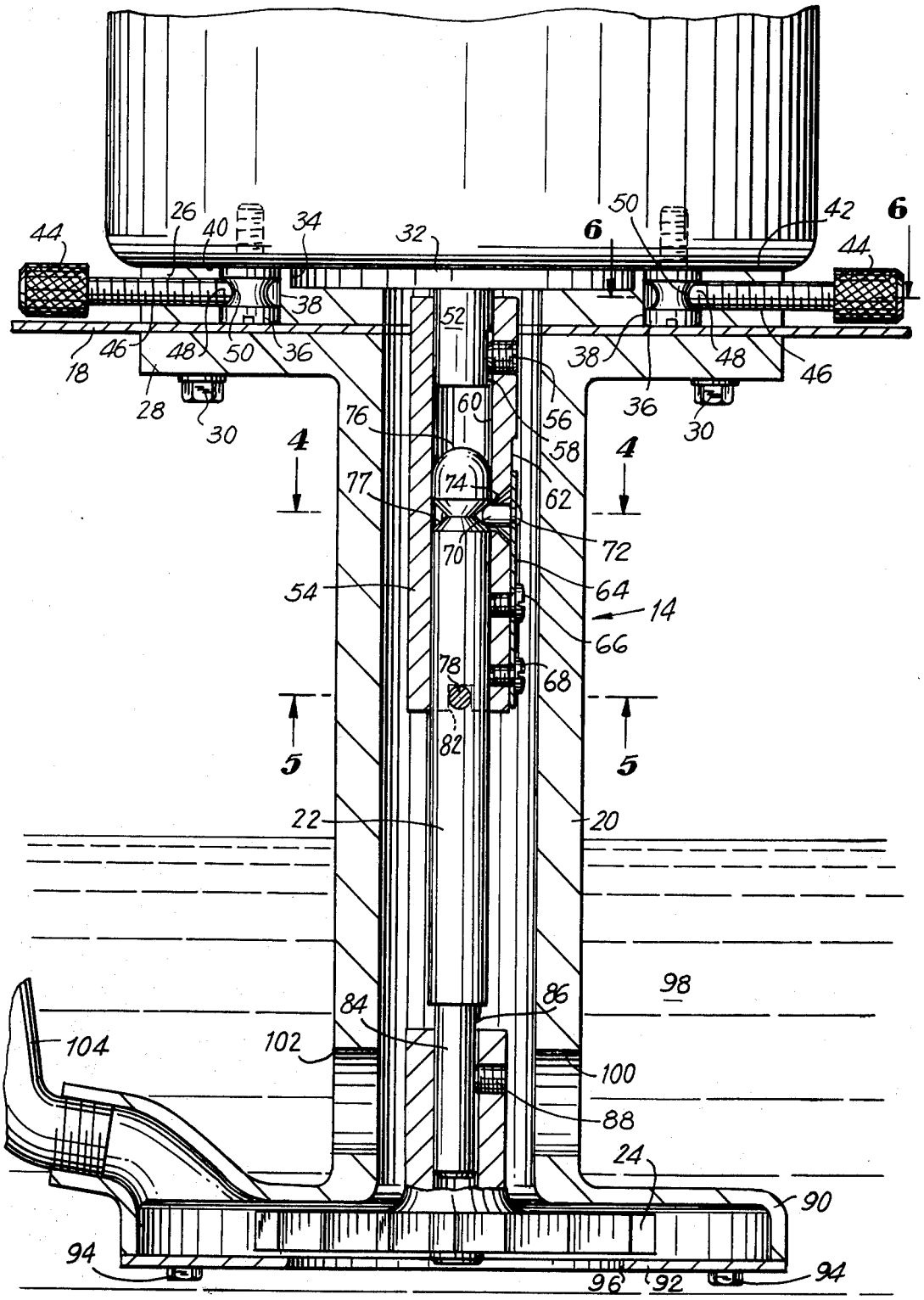
FIG. 3 is an expanded cross-sectional view of the centrifugal pump assembly depicted in FIG. 1.
Figure 4:
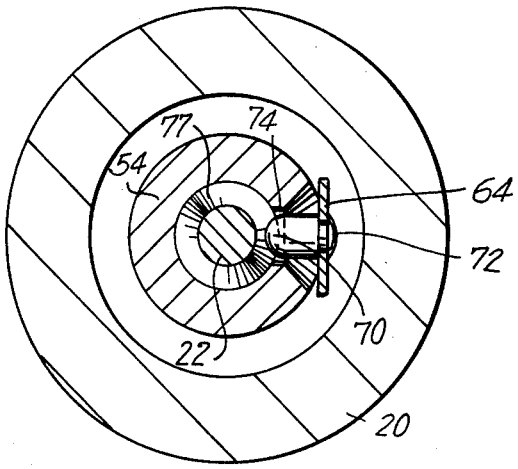
FIG. 4 is a sectional view taken on the line 4—4 of FIG. 3.
Figure 5:
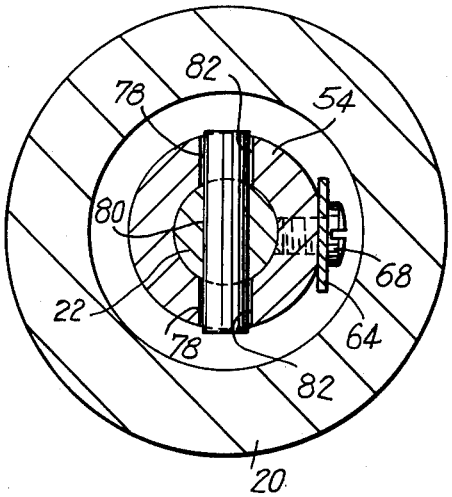
FIG. 5 is a sectional view taken on the line 5—5 of FIG. 3.
Figure 6:
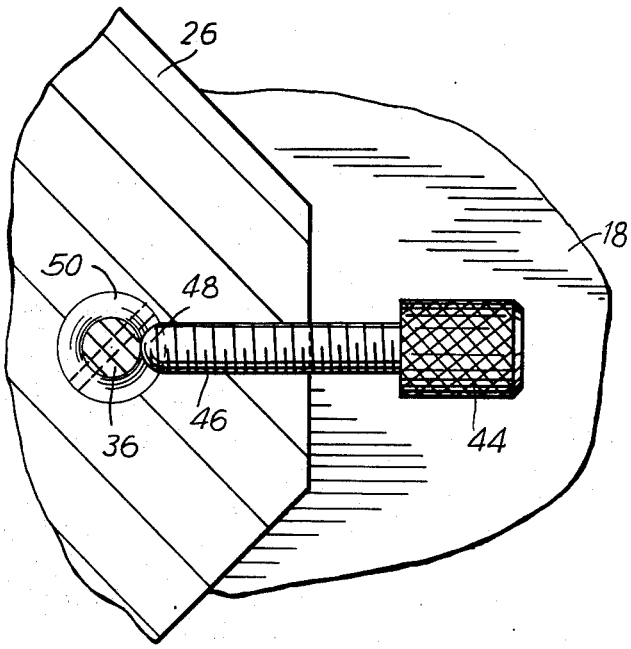
FIG. 6 is a sectional view taken on the line 6—6 of FIG. 3.

Referring now to FIG. 1, there is illustrated a perspective view of the centrifugal pump assembly in conjunction with the ink reservoir of a printing press, and which is constructed in accordance with the principles of the present invention. The pump assembly is generally denoted by the reference numeral 10 and includes the electrical motor 12 and the impeller assembly 14. The ink reservoir or vat 16 includes a cover member or plate 18. The impeller assembly 14 comprises the impeller housing 20, impeller shaft 22 and the impeller 24. The assembly 10 also includes a motor mounting hub 26. The hub 26 is positionally secured with respect to the cover plate 18 and to the impeller housing 20 and more particularly, to the upper flange portion 28 of the impeller housing, by means of bolts 30 which pass through the upper flange portion 28, the cover plate 18 and the hub 26.

The motor 12 has an end wall 32, of substantially circular configuration, which is seated within a circular recess 34 formed in the hub 26. The motor also includes a pair of grooved locating studs 36 which are positionally disposed within bores 38 formed in the hub. In this regard, it is to be noted that the thickness of hub 26, and thus of bores 38, is substantially equal to the height of the external portion of the studs 36, wherefore, the bottom end 40 of motor 12 is disposed in abutting engagement with the top 42 of hub 26. The motor 12 is secured in releasable engagement to the hub 26 by means of threaded knurled bolts 44 which extend through threaded lateral bores 46 in the hub 26. The rounded distal ends 48 of the bolts 44 are positionable in seated engagement in the peripheral grooves 50 of the motor locating studs 36, and when in this position, secures the motor with respect to the hub.

The motor 12 includes a centrally disposed rotatable shaft 52 to which is secured a coupling sleeve 54 by means of a recessed set screw 56. It is to be noted that the shaft 52 is provided with a flat 58 slightly spaced from the inner bore 60 of the coupling sleeve 54 to enable secured engagement of the sleeve with respect to said shaft. The lower portion of sleeve 54 is provided with a recessed flat 62 to which a leaf spring 64 is secured by means of screws 66 and 68. A laterally protruding locator pin 70 is secured to the upper or free end of the leaf spring 64 by means of a riveted head 72. The pin 70 extends through a countersunk hole 74 formed in said sleeve and projects into the sleeve.

The upper end of the impeller shaft 22 is disposed within bore 60 in the sleeve 54 and the head 76 of shaft 22 is rounded to facilitate the insertion of the head into bore 60, as will be explained more fully hereinafter. When the head 76 is positioned within bore 60, proper vertical alignment of impeller shaft 22 and, more particularly, impeller 24 is obtained by engagement of the locator pin 70 within the V-shaped peripheral groove 77 formed in the upper end portion of shaft 22, adjacent head 76. Centrally disposed within shaft 22 and laterally extending therethrough is a drive pin 78 adapted to be engaged by the laterally extending slot 80 formed in sleeve 54 by means of diametrically opposed notches 82 provided in the lower end of sleeve 54. Seating engagement of the drive pin 78 in the slot 80 causes concomitant rotational movement of impeller shaft 22 with coupling sleeve 54, as will also be explained in more detail hereinafter. It is herein to be noted that the positioning of locator pin 70 within the groove 77 cannot occur until drive pin 78 is engaged in slot 80.

The impeller shaft 22 is provided with a reduced lower portion 84 having a recessed flat 86. The impeller 24 is secured to impeller shaft portion 84 by a set screw 88 which abuttingly engages the flat 86. The lower portion of the impeller 24 is disposed within the impeller hub 90. The hub 90 is provided with an underside cover 92 secured thereto by means of bolts 94 and has a central inlet aperture 96.

In the operation of the centrifugal pump assembly 10, starting of the motor 12 causes rotational movement of motor shaft 52 and the coupling sleeve 54. By virtue of the positive engagement of drive pin 78 in slot 80, there is corresponding rotational movement of the impeller shaft 22 and thus, of the impeller 24. Rotational movement of impeller 24, in turn, causes the inward flow of ink, generally denoted 98, through the inlet aperture 96 and inlet apertures 100 and 102 formed in impeller housing 20. The ink 98 is then pumped by centrifugal force upwardly through outlet tube 104 into a T coupling 106 provided with a bypass valve (not shown) which supplies the major portion of ink flowing in outlet tube 104 to a flexible tube 108 connected to the ink fountain (not shown) of the printing press. The valve also provides for a small amount of ink flow from tube 104 to the reservoir inlet tube 110. The flow of ink from tube 104 through T coupling 106 and tube 110 serves to produce a circulatory flow which keeps the ink 98 in reservoir 16 sufficiently mixed to prevent any residue or pigmentation settling from occuring therewithin. The inlet tube 110 is also connected via coupling 112 to the fountain return tube 114 from whence the ink overflow from the fountain is returned to the reservoir 16.

Figure 2:
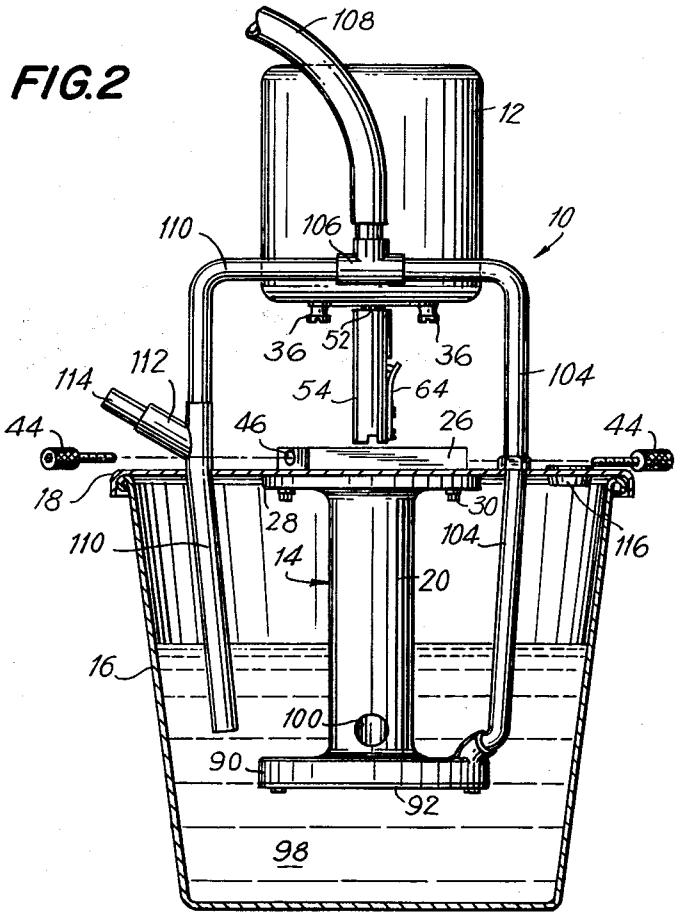
FIG. 2 is a partial sectional view of the centrifugal pump assembly of FIG. 1 with the component members thereof in their disassembled state.

As best seen in FIG. 2, the cover plate 18 is provided with a peep inlet hole 116 having a pivotal cover 118. The peep hole 116 permits for visual inspection of the ink 98 and the provision of an additional mount of ink to the reservoir 16 without necessitating the cessation of operation of the centrifugal pump assembly; however, if desired the pump may be stopped and the entire cover member 18 may be lifted to provide an additional supply of ink to the reservoir.

When the pump assembly 10 has to be cleansed or repaired, the motor 12 is stopped and disconnected by removing the line cord 120 from the power receptacle. Thereafter the pump is disassembled by unscrewing knurled bolts 44 until the distal ends 48 thereof have become disengaged from the grooves 50. The motor 12 is then capable of being released from its engagement with hub 26 by merely lifting the same upwardly. This upward movement of motor 12 causes the coupling sleeve 54 secured to motor shaft 12 to become disengaged from impeller shaft 22 by causing the impeller shaft portion adjacent the V-shaped groove 77 to urge the locator pin outwardly of the hole 74 by deflection of the leaf spring 64. This also causes disengagement of the drive pin 78 from within the slot 80. After the sleeve 54 has been removed from the impeller shaft 22, the impeller 24 becomes misaligned with respect to the assembly 20 and abuts the hub 90, wherefore care must be taken to properly align the impeller 24 before restarting the pump assembly 10. Of course, separation of the coupling sleeve 54 from the impeller shaft 22 permits withdrawal of the sleeve from the circular recess 34, thereby separating the motor from the remainder of the pump assembly 10 and reservoir 16. The remainder of the pump assembly which includes the impeller assembly and reservoir may then be completely immersed in any type of solvent or cleaning solution without any danger of impairment or deleterious effect upon the motor.

After the impeller assembly 14 and reservoir 16 have been cleaned the pump assembly 10 is readily reassembled by insertion of the coupling sleeve 54 into impeller housing 20. In this regard, the person reassembling the pump need merely place the impeller hub upon a flat surface and then slowly rotate the motor a maximum of 180° until the slot aligns itself with the drive pin 78. Thereafter, the motor is permitted to descend a slight distance further until the groove 77 is disposed adjacent hole 74 and the locator pin 70. When this occurs, pin 70 seats itself within groove 77 and urges the impeller shaft 22 into proper vertical alignment which also causes proper alignment of impeller 24 within the hub 90. Thus, the cover plate 18 may thereafter be placed upon vat 16 and the pump assembly 10 is again ready for operation.

Figures 7, 8:
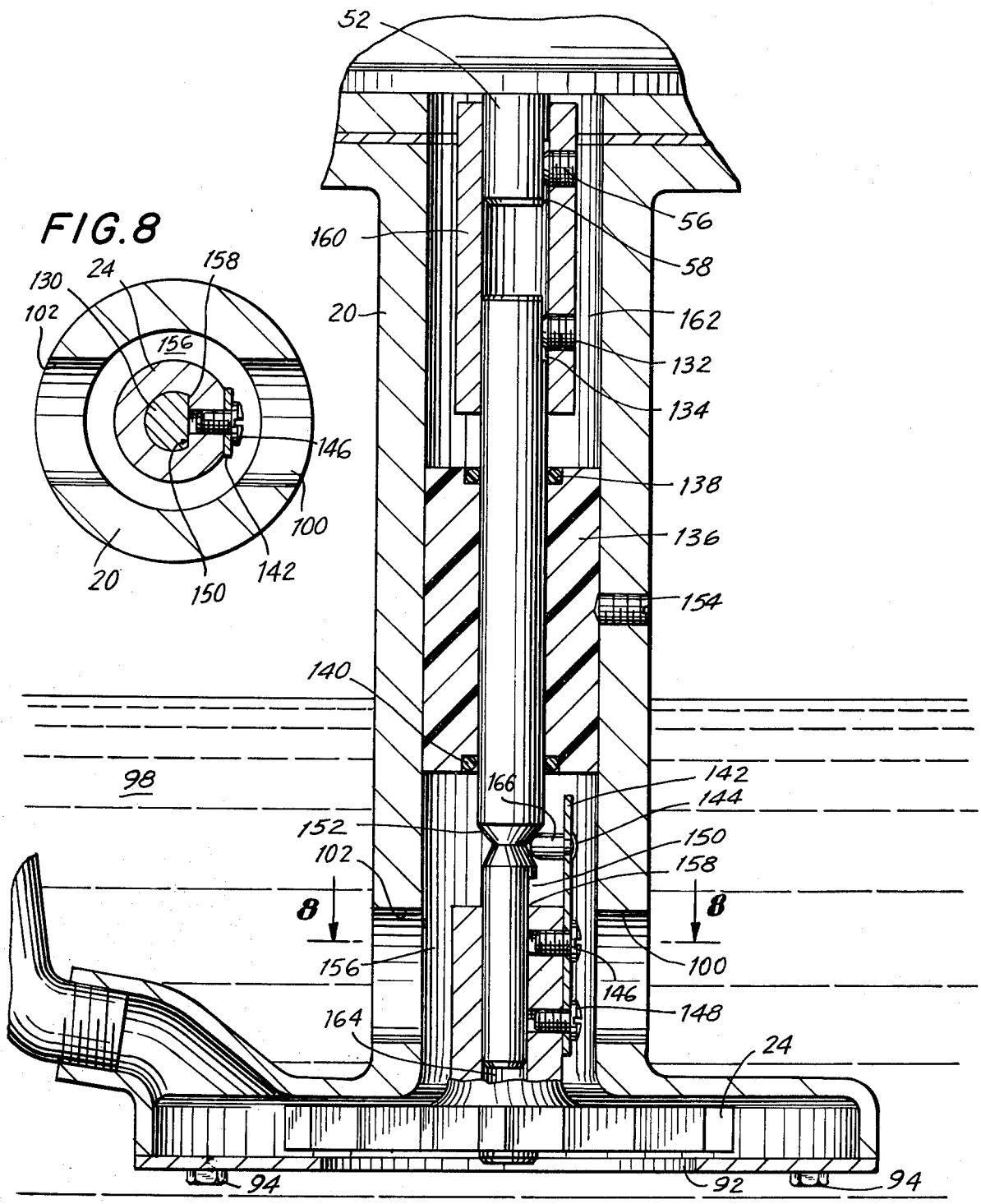
FIG. 7 is a partial sectional view of the new centrifugal pump assembly having an ink barrier sleeve.
FIG. 8 is a sectional view taken on line 8—8 of FIG. 7.

FIGS. 7 and 8 illustrate a modified coupling sleeve 160 utilizing recessed set screw 56 to engage the coupling sleeve secured to shaft 52. Recessed set screw 56 seats itself on flat 58. The extended motor shaft 130 is attached to modified coupling sleeve 160 utilizing additional recessed set screw 132. Set screw 132 engages flat 134. Extended motor shaft 130 is in co-axial alignment with shaft 52 and rotates concurrently therewith. The extended motor shaft 130 passes through hollow barrier sleeve 136, which is utilized to prevent ink 98 entering void 156 from communicating into void 162. The bearing (not shown) supporting shaft 52 is maintained in an ink-free atmosphere.

Hollow barrier sleeve 136 is retained within impeller housing 20 by hollow barrier sleeve locking set screw 154. Upper O-ring 138 and lower O-ring 140 serve as ink seals for extended motor shaft 130 which is capable of rotation therewithin.

The free end of the extended motor shaft 130 is adapted with flat 150. The flat engages an opposing complementary flat surface 158 in opening 164 of impeller 24 allowing the opposed flat surfaces to permit extended motor shaft 130 to be rotationally joined with impeller 24. Leaf spring 142 is secured to impeller 24 utilizing screws 146 and 148. Laterally protruding locator pin 166 is fastened to leaf spring 142 utilizing riveted head 144. The laterally protruding locator pin 142 engages V-shaped peripheral groove 152 causing impeller 24 to be supported on extended motor shaft 130 while impeller 24 is rotated by extended motor shaft 130 utilizing flat 150 and complementary flat surface 158. Impeller 24 can be disengaged from extended motor shaft 130 by a downward directed motion exerted on impeller 24 after underside cover 92 is removed from impeller housing 20.

After the impeller 24 and reservoir 16 have been cleaned, the pump assembly is readily assembled by the insertion of extended motor shaft 130 into the opening 164 in the impeller. The impeller is simply rotated while the motor shaft and the extended motor shaft 130 are prevented from rotation until the flat 150 is aligned with the complementary flat surface 158. The assembler then places a moderate amount of force on the impeller in the direction of the motor, causing the impeller, now properly angularly aligned relative to the extended motor shaft, to reach the point at which laterally protruding locator pin 166 engages the V-shaped peripheral groove 152 so as to support the impeller 24 on the extended motor shaft 130.

Impeller 24, after disengagement from extended motor shaft 130 exposes void 156. The impeller and the lower portions of the impeller housing 20 can be cleaned utilizing solvents.

Void 156 is isolated from void 162 so that none of the cleaning solvent enters void 162 protecting thereby the bearing, (not shown) supporting motor shaft 152. Coupling sleeve 160 and the uppermost portions of the extended motor shaft 130 are included within void 162 and are protected from invasive attack by the solvent and prior to the removal of the impeller by the ink. The surfaces of hollow barrier sleeve 136 are preferably fabricated from polytetrafluoroethylene, otherwise known as "teflon" a product of E. I. Dupont, insuring a low co-efficient of friction between extended motor shaft 130 and the opening in the barrier sleeve through which extended motor shaft 130 passes. O-rings 138 and 140 act as an additional ink seal preventing cleaning solvents or ink from inadvertant communication into void 162. The O-rings are preferably fabricated from a synthetic rubber material possessing resistive properties to the corrosive effects of cleaning solvents and ink.

In the event that extended motor shaft 130 or modified coupling sleeve 160 and its associated set screws 56 and 132 require servicing or replacement, or if it is desired to disassemble the motor shaft from the remainder of the pump assembly, two methods may be employed to gain access to the modified coupling sleeve and the extended motor shaft or to release the motor from engagement with the pump assembly.

After removal of impeller 24, extended motor shaft 130 may be withdrawn from hollow barrier sleeve 136 by disengaging the motor from the pump assembly housing. Modified coupling sleeve 160 and extended motor shaft 130 are thus exposed.

Alternatively, set screw 154 may be loosened, unlocking hollow barrier sleeve 136 from its operating position within impeller housing 20 releasing the motor from the housing permits modified coupling sleeve 160, extended motor shaft 130 and the hollow barrier sleeve 136 to be withdrawn upwardly as the motor is separated upwardly from the housing. Access is available to O-rings 138 and 140 as well as the remaining rotational components utilized to connect the rotational driving forces produced by motor shaft 52 to rotate impeller 24.

It is thus seen that we have provided a new and novel split shaft centrifugal pump arrangement wherein the motor is simply and readily releasably engageable with the impeller assembly, so as to effect quick engagement and disengagement of the motor and wherein, the motor and impeller shaft are releasably engageable by positive drive connection means which also provides proper alignment of the pump components at the time of engagement.

While we have shown the preferred embodiment of our invention, it will be readily apparent to those skilled in the art that there are many modifications, changes and improvements which may be made therein without departing from the spirit and scope of the invention as hereinabove described.

What is claimed is:

1. A centrifugal pump apparatus comprising
a motor assembly, and
an impeller assembly,
said motor assembly comprising
an extended motor shaft, and
motor shaft extending means
for extending the length of said motor shaft,
said extended motor shaft being rotationally coupled to said motor shaft and in coaxial alignment therewith,
said impeller assembly comprising
a housing having an upper portion and a lower portion, and
an impeller,
coupling means disposed within said upper housing portion for releasably securing said impeller to said extended motor shaft and for providing concomitant rotational movement of said impeller with said extended motor shaft,
said motor shaft and said extended motor shaft extending into said upper housing portion,
said coupling means including alignment means for longitudinally and laterally aligning said impeller within said lower housing portion and for positioning said extended motor shaft and said impeller in coaxial alignment,
ink barrier means for preventing the flow of ink along part of the length of said extended motor shaft and along an adjacent void within said upper housing portion,
said coupling means comprising a flattened surface on said extended motor shaft,
said flattened surface being disposed in a plane parallel to the longitudinal axis of said extended motor shaft,
said impeller having a hub portion with an opening therein,
said flattened surface being engageable within said opening,
said opening having a mating flattened surface therein, and
said mating flattened surface being capable of engaging said flattened surface.

2. A centrifugal pump apparatus in accordance with claim 1, wherein
said coupling means comprises
a groove formed in said extended motor shaft, and
a locator pin laterally movable inwardly and outwardly of said longitudinal axis of said extended motor shaft,
said locator pin being capable of being seated within said groove, and
said seated engagement of said locator pin within said groove serving to releasably secure said impeller with respect to said extended motor shaft and positioning said impeller in coaxial alignment with said extended motor shaft.

3. A centrifugal pump apparatus in accordance with claim 2, wherein said impeller is provided with a hub portion, the exterior surface of said hub portion being coaxially aligned with said opening in said impeller, a spring member secured to said exterior surface of said hub portion, means for securing said locator pin to a free end of said spring member to permit lateral inward and outward movement of said locator pin with respect to said groove, and said pin being laterally movable in dependence upon the vertical movement of said impeller.

4. A centrifugal pump apparatus in accordance with claim 3, wherein the lower end of said extended motor shaft is beveled to facilitate the initial engagement of said hub portion and said extended motor shaft.

5. A centrifugal pump apparatus in accordance with claim 3, wherein said groove formed in said extended motor shaft is of V-shaped configuration and extends laterally about the peripheral surface of said extended motor shaft.

6. A centrifugal pump apparatus comprising a motor assembly, and an impeller assembly, said motor assembly comprising an extended motor shaft, and motor shaft extending means for extending the length of said motor shaft, said extended motor shaft being rotationally coupled to said motor shaft and in coaxial alignment therewith, said impeller assembly comprising a housing having an upper portion and a lower portion, and an impeller, coupling means disposed within said upper housing portion for releasably securing said impeller to said extended motor shaft and for providing concomitant rotational movement of said impeller with said extended motor shaft, said motor shaft and said extended motor shaft extending into said upper housing portion, said coupling means including alignment means for longitudinally and laterally aligning said impeller within said lower housing portion and for positioning said extended motor shaft and said impeller in coaxial alignment, ink barrier means for preventing the flow of ink along part of the length of said extended motor shaft and along an adjacent void within said upper housing portion, said motor shaft extending means comprising a sleeve, said sleeve engaging said motor shaft at one end thereof and engaging the upper end of said extended motor shaft at the other end thereof, said sleeve being in coaxial alignment with said motor shaft and said extended motor shaft, said ink barrier means comprises a barrier sleeve member, said barrier sleeve member having an opening extending therethrough, said part of said extended motor shaft being located intermediate said other end of said sleeve and said groove and passing through said opening in said barrier sleeve member, said upper portion of said housing having internal walls adjacent said part of said extended motor shaft, said barrier sleeve member having the external surfaces thereof disposed in touching engagement with said internal walls of said upper portion of said housing, means for securing said external surfaces of said barrier sleeve member to said internal walls of said upper housing portion, and seal means for preventing the flow of ink along said part of said extended motor shaft and said opening extending through said barrier sleeve member.

7. A centrifugal pump apparatus in accordance with claim 6, wherein said securing means comprises a set screw threadingly engaged within said internal walls of said upper housing portion, and said set screw engaging said external surfaces of said barrier sleeve member.

8. A centrifugal pump apparatus in accordance with claim 6, wherein said seal means comprises a pair of O-rings, said pair of O-rings having elasticity and being compressable, uppermost and lowermost annular grooves formed in said barrier sleeve member, said uppermost annular groove being positioned adjacent the uppermost portion of said opening in said barrier sleeve member, said lowermost annular groove being disposed adjacent the lowermost portion of said opening in said barrier sleeve member, one of said O-rings being positionally disposed in said uppermost annular groove, and the other of said O-rings being positionally disposed in said lowermost annular groove.

* * * * *